United States Patent [19]

Joshi

[11] 4,451,386

[45] May 29, 1984

[54] DETERGENT TABLET

[75] Inventor: David P. Joshi, Piscataway, N.J.

[73] Assignee: Colgate-Palmolive Company, New York, N.Y.

[21] Appl. No.: 427,987

[22] Filed: Sep. 29, 1982

Related U.S. Application Data

[63] Continuation of Ser. No. 747,585, Dec. 6, 1976, Pat. No. 4,370,250.

[51] Int. Cl.[3] ..... C11D 3/075; C11D 3/08; C11D 11/02; C11D 17/00

[52] U.S. Cl. ..... 252/135; 252/174; 264/109; 264/120

[58] Field of Search ..... 252/91, 99, 134, 135, 252/174, 174.21, DIG. 16; 264/109, 120

[56] References Cited

U.S. PATENT DOCUMENTS

| | | | |
|---|---|---|---|
| 3,081,267 | 3/1963 | Laskey | 252/135 |
| 3,247,123 | 4/1966 | Schrager | 252/135 |
| 3,329,615 | 7/1967 | Cooper | 252/99 |
| 3,331,780 | 7/1967 | Krusius | 252/135 |
| 3,338,836 | 8/1967 | Krusius | 252/99 |
| 3,344,076 | 9/1967 | Wilcox | 252/135 |
| 3,367,880 | 2/1968 | Keast | 252/539 |
| 3,383,321 | 5/1968 | Davis | 252/135 |
| 3,417,024 | 12/1968 | Goldwasser | 252/135 |
| 3,423,322 | 1/1969 | Cooper | 252/135 |
| 4,276,326 | 6/1981 | Joshi | 427/220 |
| 4,310,431 | 1/1982 | Joshi | 252/91 |
| 4,370,250 | 1/1983 | Joshi | 252/135 |

*Primary Examiner*—Dennis L. Albrecht

[57] ABSTRACT

A process for producing detergent tablets from free flowing spray dried base builder beads comprising inorganic detergent builders. The builder beads comprise alkali metal phosphate, alkali metal silicate and water. The alkali metal phosphate, component includes a hydrated and an anhydrous portion. Relatively large amounts of liquid or liquifiable detergent ingredients such as surface active agents etc. can be applied to the base beads after spray drying, without destroying their free flowing properties. The base beads are suitable for compression into coherent tablets. The resulting tablets are of improved detergency, physical integrity and solubility.

21 Claims, 3 Drawing Figures

1/200"

1/2000"

DETERGENT TABLET

This is a continuation, of application Ser. No. 747,585 filed Dec. 6, 1976, now U.S. Pat. No. 4,370,250 issued Jan. 25, 1983.

FIELD OF INVENTION

The present invention pertains to the manufacture of cohesive tablets having detersive and cleaning properties hereinafter referred to as cleaning tablets. The cleaning tablets of the invention comprise an agglomeration of free flowing detergent builder beads carrying relatively large amounts of various surface active agents and other liquid or semisolid materials. Specifically the invention provides a method for producing spray dried base builder beads that are oversprayed with synthetic detergents such as nonionics, anionics and cationics or combinations thereof to produce a granular detergent formulation that is particularly suitable for compression and agglomeration into cleaning tablets of improved detergency, physical integrity and solubility. The new cleaning tablets contain relatively large amounts of a synthetic detergent component. The invention is particularly useful in providing a granular free flowing detergent suitable for agglomeration into tablet form and having a high content of nonionic synthetic organic detergent. As used herein the terms overspray and post spray are equivalent and should be taken to include any suitable means for applying a liquid or liquifiable substance to the spray dried base builder beads of the invention, including, of course, the actual spraying of the liquid through a nozzle in the form of fine droplets.

BACKGROUND AND PRIOR ART

Typically, nonionic synthetic detergents having the desired detergency properties for incorporation into commercial granular detergent products, such as laundry powders and tablets are thick, viscous, sticky liquids or semi-solid or waxy materials. The presence of these materials in a detergent slurry (crutcher mix) prior to spray drying in amounts greater than about 2–3 percent by weight is impractical since the nonionic synthetic detergent will "plume" during spray drying and a significant portion can be lost through the gaseous exhaust of the spray drying tower.

The art has recognized the application of nonionic synthetic detergents of this type to various particulate carrier bases to produce relatively free flowing granular materials that can be used as household laundry products. Representative patents containing teachings and disclosures of methods for producing granular free flowing laundry detergents by post spraying a nonionic synthetic organic detergent onto a spray dried particulate product containing detergent builders include: among others: Di Salvo et al U.S. Pat. Nos. 3,849,327 and 3,888,098; Gabler et al U.S. Pat. No. 3,538,004; Kingry U.S. Pat. No. 3,888,781; and British Pat. No. 918,499 (Feb. 13, 1963). The prior art in this regard is typified by post spraying from about 1 to a maximum of 10 percent by weight of a nonionic synthetic detergent onto a spray dried bead that contains a substantial proportion of a surface active agent such as anionic detergents, filler materials, and detergent builders.

Further, certain desirable ingredients for detergent formulations such as cationic surface active agents that provide fabric softening properties and optical brighteners, bluing agents and enzymatic materials cannot be spray dried because of thermal composition. Such materials can be incorporated into a granular detergent according to the invention by post spraying them onto the spray dried base builder beads either alone or in addition to a nonionic detergent or other suitable ingredients.

Detergent formulations in the form of cleaning tablets are known in the art, i.e., for example see U.S. Pat. Nos. 2,875,155; 3,034,911; 3,081,267; 3,247,122; 3,247,123; 3,370,015; 3,417,024 and 3,503,889 and many others.

For a cleaning tablet to be commercially acceptable, it must be of sufficient strength so that it will not break under normal production, packaging and handling conditions, yet it must also be readily dispersed in cold water so as to provide the desired function comparable to that of the granular or liquid products, which are, because of their physical nature, readily dispersable in the washing medium. A disintergration time for a detergent tablet of about three minutes or less is considered to be a highly desirable rate from both the viewpoint of amount of cleaning, which is a function of the rate of the detergent being dispersed in the water, and the minimization of spotting of the clothes, which might be caused by local concentrations of detergent, e.g., large pieces of the tablet being trapped in the clothes. Additionally, overcoming these problems is further complicated by the need today for cleaning products which are equally suitable for both hot water and cold water applications. Cold water washing, in particular, is especially important because of the need to conserve energy and it is important that the tablets may be used interchangeably for either cleaning application. Cold water, in terms of cleaning products, usually means tap water, which has a temperature range of about 70° F.

The art has attempted to resolve the dichotomy between a cleaning tablet having sufficient physical strength and satisfactory water-dispersability, as well as other associated problems normally encountered with such tablet products, by using a very specialized cleaning formulations and processing techniques. The solution to these problems is beset with many difficulties however. Handling of the tablet without breakage normally requires the tablet to have a high strength; but, cleaning tablets normally disintegrate much more slowly as the tablet strength is increased. These competing forces, coupled with the inherent nature of cleaning tablets to be much more readily disintegrated in hot water than in cold water, presents the manufacturer with formidable problems to be overcome to provide tablets having the desired characteristics.

Further, the operation of a conventional tablet press is hampered drastically if the base powder beads to be compressed into tablet form are (a) not free flowing (b) sticky and tacky (c) light in density with correspondingly high bulk and (d) weak and fragile when compressed.

A primary advantage of the invention is to provide base detergent beads that are free flowing so as not to impede the tablet press and can be readily formed into cleaning tablets of improved physical integrity and disintegration rate in the washing medium.

SUMMARY OF THE INVENTION

In one specific aspect the invention provides a method for producing spray dried builder beads that are suitable for carrying relatively large amounts i.e. about 2 to about 40 percent by weight, preferably from about 12 to about 30 percent, of various detergent ingredients such as anionic, nonionic, cationic surface active agents, optical brighteners, bluing agents, soil release agents, antiredeposition agents etc. and mixtures thereof. The post added detergent ingredients are applied in liquid form onto the base beads by any suitable means, preferably by spraying in the form of fine droplets from a spray nozzle while the beads are being agitated. In its broadest sense the invention contemplates the post addition or application of any liquid or liquifiable organic substance, that is suitable for incorporation into a laundry detergent formulation, onto spray dried base builder beads comprising inorganic detergent builders.

The new base builder beads of the invention are characterized by spherical or irregularly shaped particles or beads comprising from about 45 to about 80 percent phosphate builder salt, from about 5 to about 15 percent alkali metal silicate solids and from about 5 to about 15 percent water. From about 30 to about 60 percent of the alkali metal phosphate component is hydrated in the presence of the alkali metal silicate component and the remainder is in anhydrous form. The beads can be classified as solid as opposed to the hollow beads typical of spray dried powders, and have a porous, sponge-like outer surface and a skeletal internal structure.

According to the invention, the post sprayed ingredients are primarily disposed internally of the outer surface of the particles and is minimally present on the outer surface of the particles. The resulting product is free flowing and without a significant tendency to stick together or agglomerate. Desirably less than about 10 percent by weight of the oversprayed material is present on the outer surface of the final beads.

The free flowing ability of a granular or particulate substance can be measured in relation to the flowability of clean dry sand under predetermined conditions, such as inclination with the horizontal plane, which is assigned a flowability value of 100. Typical spray dried detergent powders as presently available on the market have a relative flowability of about 60 in relation to sand i.e. 60 percent of the flowability of sand under the same conditions. Surprisingly the new granular product of the invention has a flowability value of at least about 70 in relation to clean dry sand under the same conditions and up to about 90 or more. The unexpectedly high degree of flowability of the new base beads renders them particularly suitable for compression into cleaning tablets since they have a minimal tendency to clog conduits and presses used in making tablets.

The new base builder beads according to the invention can be further characterized as follows:

Particle size distribution: at least about 90% by weight passing through a 20 mesh screen (U.S. series) and being retained on a 200 mesh screen (U.S. series).

Density (Sp Gravity): 0.5–0.80

Flowability: 70–100 (relative to clean dry sand)

The novel base beads of the invention can be produced as follows:

A first quantity of a hydratable alkali metal phosphate builder salt is hydrated in the presence of a second quantity of an alkali metal silicate; the weight ratio of the first quantity to the second quantity being from about 1.5 to about 5. The hydrated phosphate and silicate are mixed in an aqueous medium at a temperature of at least about 170° F. with a third quantity of anhydrous alkali metal phosphate builder salt to form a slurry, or crutcher mix; the weight ratio of the first quantity to the third quantity being from about 0.3 to about 0.7. Various other detergent ingredients i.e. builders such as carbonates, citrates, silicates, etc., and organic builders, and surface active agents can be added to the crutcher mix after the hydration step. According to the invention it is preferred that the presence of organic surface active agents in the crutcher mix be limited to less than 2 percent of the solids present and most preferably that the crutcher mix be free from organic surface active agents. The crutcher mix is agitated and maintained at a temperature from about 170° F. to about 200° F. to prevent any significant hydration of the third quantity of anhydrous phosphate builder salt. Sufficient water is present in the slurry so that the crutcher mix contains from about 40 to about 55 percent solids. Adjuvants such as brighteners, bluing, or other minor ingredients may be present in the crutcher mix if necessary or desirable or may be post added to the spray dried beads.

The crutcher mix is then pumped to a spray tower where it is spray dired in the conventional manner. The spray drying may be performed in a countercurrent or co-current spray drying tower using an air inlet temperature from 500° to 700° F. and a spray pressure from about 200 psig to about 1000 psig. The spray dried product comprises a large plurality of particles having a novel sponge-like structure as opposed to the hollow structure that typically results from spray drying a detergent crutcher mix.

According to the invention, the nonionic synthetic detergent is then applied on to the spray dried builder beads while they are being agitated, in an amount of from about 10 to about 40 percent by weight of the final product. Nonionic synthetic detergent impregnates the pores or openings on the surface of the beads and passes into the skeletal internal structure; an insignificant amount if any, of the non-ionic component remaining on the bead surface. The minimal amount of nonionic detergent on the outer surface of the beads is evidenced by the substantially similar flowability rates obtained for the beads before and after they are sprayed with the nonionic component. A similar process is used to apply other post added ingredients, as disclosed herein, to the spray dried detergent builder beads.

During the overspraying operation, while the base beads are being agitated, or immediately thereafter, a disintegratng side is added to the beads in an amount of from about 1 to about 5 percent by weight based on the final weight of the oversprayed beads. The disintegrating aide is optional and satisfactory results according to the invention can be obtained without its presence.

The spray dried builder beads and disintegrant (if desired) are formed into cleaning tablets by feeding the beads to a conventional tableting press and compressing at sufficient pressure, typically from about ¾ ton to about 3 tons per square inch, to form a coherent mass.

The resulting tablets weigh from about 20 to about 50 grams, have a diameter from about 1 to about 2 inches and comprise from 10 to about 40 percent surface active agent about 85 to about 35 percent builder beads and from about 1 to about 5 percent disintegration aide.

BRIEF DESCRIPTION OF THE DRAWING

The drawing accompanying this application includes two photomicrographs of a spray dried builder bead or particle according to the invention prior to being post sprayed.

DESCRIPTION OF PREFERRED EMBODIMENTS

Figure 1:
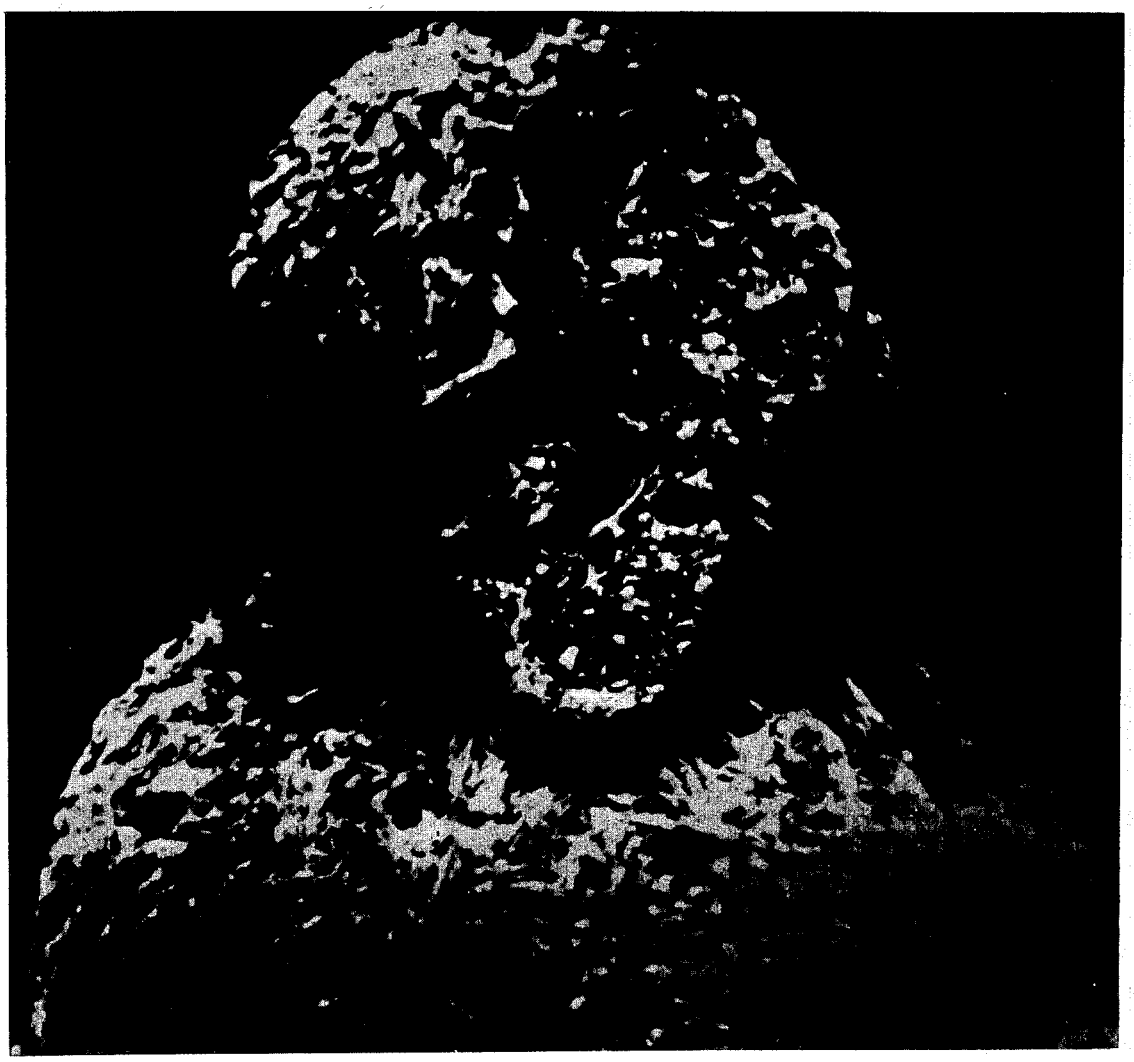
FIG. 1 shows the major portion of a base bead according to the invention magnified 200 X.
Figure 2:
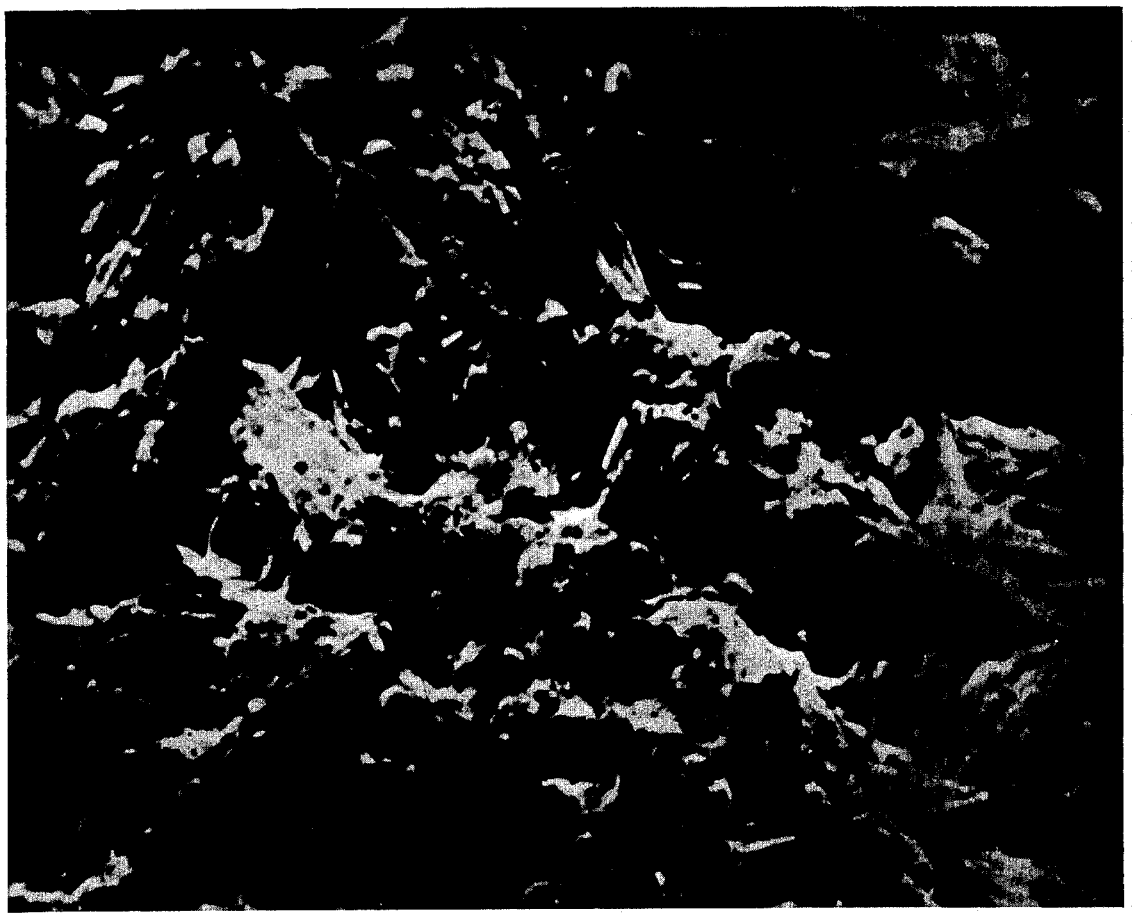
FIG. 2 shows a cut away portion of the base bead of FIG. 1 magnified 2000 X.

As shown in the drawing the base builder beads comprise solid particles of irregular configuration that have a sponge-like, porous outer surface and a skeletal internal structure. In contrast, conventional spray dried detergent beads such as those currently available on the consumer market typically comprise spherical particles or beads with a substantially continuous outer surface and a hollow core.

The new base builder beads comprise by weight, from about 45 to about 80 percent phosphate builder salt, preferably from about 50 to about 70 percent; from about 5 to about 15 percent alkali metal silicate solids, and from 5 to about 15 percent water. According to a specific aspect of the invention, a substantial portion of the builder salt component of the base beads is the product of hydrating to a maximum degree, typically to the hexahydrate form, from about 30 to about 60 percent of the phosphate builder salt component in the presence of alkali metal silicate. In further accordance with this specific aspect of the invention, the weight ratio of hydrated phosphate builder salt to alkali metal silicate in both the crutcher mix and base beads is from about 1.5 to about 5, preferably about 2 to about 4, and the weight ratio of hydrated phosphate builder salt to anhydrous builder salt in the crutcher mix and base beads is from about 0.3 to about 0.7, preferably about 0.4 to about 0.6.

In its presently preferred form, the crutcher mix of the invention contains only inorganic detergent builders and water and is free from organic surface active agents. Most preferably the crutcher mix is also free from filler materials such as sodium sulfate.

The alkali metal phosphate builder salt component of the new base builder beads is chosen from the group of phosphate salts having detergent building properties. Examples of phosphate builder salts having detergent building properties are the alkali metal tripolyphosphates and pyrophosphates of which the sodium and potassium compounds are most commonly used. These phosphates are well known in the detergent art as builders and can either be used alone or as mixtures of different phosphates. More specific examples of phosphate builder salts are as follows: sodium tripolyphosphate; sodium phosphate; tribasic sodium phosphate; monobasic sodium phosphate; dibasic sodium pyrophosphate; sodium pyrophosphate acid. The corresponding potassium salts are also examples along with mixtures of the potassium and sodium salts.

The alkali metal silicate component of the crutcher mix is supplied in the form of an aqueous solution preferably containing about 40 to 60 percent by weight typically about 50 percent silicate solids. Preferably the silicate component is sodium silicate with an $Na_2O$:-$SiO_2$ ratio from about 1:1.6 to about 1:3.4 preferably from about 1:2 to about 1:3, and most preferably about 1:2.4.

The overspray ingredients or components can be any liquid or material capable of being liquified that is suitable or desirable for incorporation into a detergent formulation. Suitable materials for overspraying onto the spray dried builder beads of the invention in amounts from about 2 to about 40 percent by weight include, but are not limited to surface active agents, antiredeposition agents, optical brighteners, bluing agents, enzymatic compounds etc.

Suitable surface active agents include anionic and nonionic detergents and cationic materials. Typical anionic materials include soap, organic sulfonates such as linear alkyl sulfonates, linear alkyl benzene sulfonates, and linear tridecyl benzene sulfonate etc. Representative cationic materials are those having fabric softening or antibacterial properties such as quaternary compounds. These last mentioned cationic materials are particularly suitable for post addition since they might thermally decompose if spray dried as part of a crutcher mix. Examples of quaternary compounds having desirable fabric softening properties are distearyl dimethyl ammonium chloride (available from Ashland Chemical under the trademark Arosurf TA100) and 2-heptadecyl-1-methyl-1-[(2-stearoylamido)ethyl]imidarzolinium methyl sulfate (also available from Ashland Chemical Co. under the trademark Varisoft 475).

The nonionic surface active agent component of the new formulation can be a liquid of semi solid (at room temperature) polyethoxylated organic detergent. Preferably, these include but are not limited to ethoxylated aliphatic alcohols having straight or branched chains of from about 8 to about 22 carbon atoms and from about 5 to about 30 ethylylene oxide units per mole. A particularly suitable class of nonionic organic detergents of this type are available from the Shell Chemical Company under the Trademark "Neodol". Neodol 25-7 (12–15 carbon atom alcohol chain; average of 7 ethylene oxide units) and Neodol 45-11 (14–15 carbon atom chain; average of 11 ethulene oxide units) are particularly preferred.

Another suitable class of ethoxylated aliphatic alcohol nonionic synthetic detergents are available under the Trademark "Alfonic" from Continental Oil Company, particularly Alfonic 1618-65, which is a mixture of ethoxylated 16 to 18 carbon atom primary alcohols containing 65 mole percent ethylene oxide.

Further examples of nonionic synthetic organic detergents include:

(1) Those available under the Trademark "Pluronic". These compounds are formed by condensing ethylene oxide with a hydrophobic base formed by the condensation of propylene oxide with propylene glycol. The hydrophobic portion of the molecule which, of course, exhibits water insolubility, has a molecular weight of from about 1500 to 1800. The addition of polyoxyethylene radicals to this hydrophobic portion tends to increase the water solubility of the molecule as a whole and the liquid character of the product is retained up to the point where the polyoxyethylene content is about 50 percent of the total weight of the condensation product.

(2) The polyethylene oxide condensates of alkyl phenols, e.g., the condensation products of alkyl phenols, having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived from polymerized propylene, dirsobutylene, octene, or nonene, for example.

Other surface active agents that may be suitable are described in the texts, "Surface Active Agents and Detergents", Vol. II, by Schwarz, Perry and Berch, published in 1958 by Interscience Publishers, Inc., and Detergent and Emulsifiers, 1969 Annual by John W. McCutcheon.

A particularly preferred detergent formulation according to the invention comprises from about 12 to about 30 percent nonionic synthetic organic detergent, most preferably of the polyethoxylated aliphatic alcohol type, oversprayed onto spray dried base builder beads produced according to the method of the invention.

Figure 3:
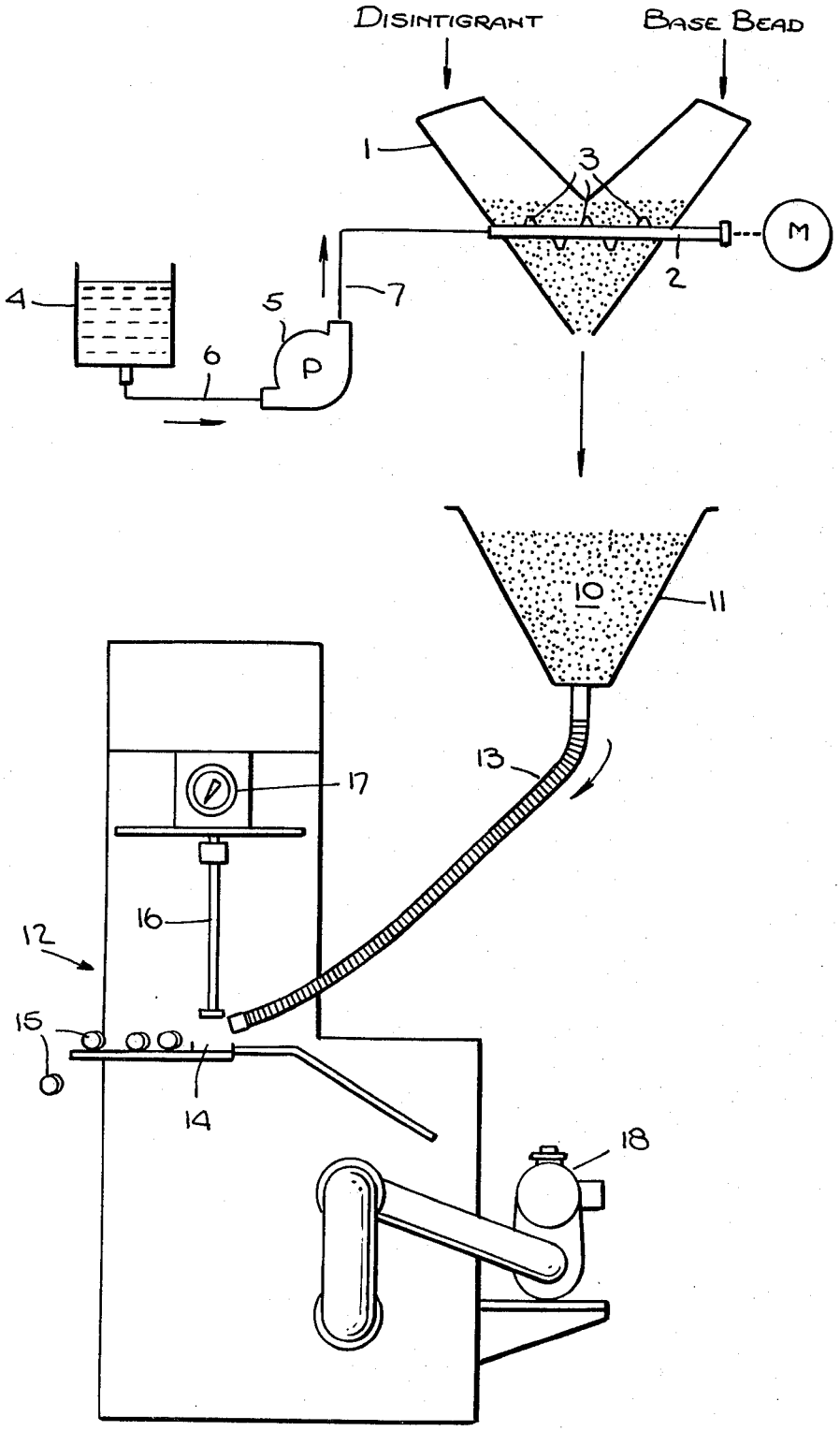
FIG. 3 is a schematic of the process of the invention.

Referring to FIG. 3 of the drawing, the process steps of the invention are shown. The crutcher mix as described above is spray dried to produce builder beads which are subsequently oversprayed in a suitable blender such as the V-blender 1, shown in FIG. 3. The V-blender 1 includes a transverse hollow bar 2 having a plurality of spray nozzles 3 for spraying nonionic onto the base beads. The nonionic is supplied to the interior of the bar 2 from reservoir 4 by pump 5 and conduits 6 and 7. Provision is made in V-blender 1 for adding disintegrant if desired. As shown in FIG. 3, the detergent beads 10 are fed from Vessel 11 to a tablet press 12 such as a Stokes Summit 15 compacting press via conduit 13.

The tablet press 12 comprises a cavity 14 in the shape of the final tablets 15, for receiving the base beads 10, a tablet punch 16, for applying the required pressure to the base beads 10, typically from ¾ ton to 3 ton per square inch, a pressure gage 17 for measuring the pressure and an electric motor 18 for driving the tablet punch and for providing power to the machine.

The following examples 1–6 describe specific embodiments of base beads 10 that are suitable for use in producing tablets according to the invention (all percentages are by weight unless otherwise specified).

EXAMPLE 1

An aqueous slurry of the following ingredients is prepared.

| Ingredient | Amount Percent (based on total crutcher mix) |
|---|---|
| Sodium tripolyphosphate powder (anhydrous) | 14.5 |
| Sodium silicate solids ($Na_2O/SiO_2$ = 2.4) | 7.6 |
| Water | 28.6 |

The slurry is brought to a temperature of about 140° F. and mixed well to form the hexahydrate phosphate salt and is subsequently heated to 190° F. and maintained between 190° F. and 200° F. to prevent hydration of the next to the added phosphate ingredient.

The following ingredients are then added to the acqueous slurry at 190° to 200° F. to form a crutcher mix.

| Ingredient | Amount Percent (based on total crutcher mix) |
|---|---|
| Sodium tripolyphosphate powder (anhydrous) | 28.3 |
| Water | 21.0 |

The crutcher mix contains from about 45 to about 50 percent solids by weight.

The crutcher mix is supplied to a countercurrent 8 foot high spray drying tower and is sprayed at a manifold temperature of 180° F. and a pressure of 600–900 psig using a Whirljet 15-1 or Fulljet 3007 spray nozzle.

An air inlet temperature ($T_1$) of about 600° F. is used in the spray tower.

The spray dried base beads produced have the following properties and are similar in internal structure and outer surface characteristics, to the bead shown in FIG. 1.

| Base Bead Properties | | |
|---|---|---|
| Moisture | 10% | |
| Tripolyphosphate (Sodium Salt) | 77% | |
| Silicate Solids | 13% | |
| Cup Weight | 130 | g. (Sp G. = 0.55) |
| Flow | 86 | |
| Tack | 0 | |
| Size Analysis: | | |
| On U.S. 20 Mesh = | 1% | |
| On U.S. 40 Mesh = | 19% | |
| On U.S. 60 Mesh = | 50% | |
| On U.S. 80 Mesh = | 20% | |
| On U.S. 100 Mesh = | 6% | |
| On U.S. 200 Mesh = | 3% | |
| Through U.S. 200 Mesh = | 1% | |
| | 100% | |

The base beads are then introduced into the V-blender shown in FIG. 3 and post sprayed with NEODOL 25-7 at 120° F. and minor ingredients such as coloring agents, perfume, brighteners, etc. to produce a final product as follows:

| | |
|---|---|
| Base Bead (above) | 78% |
| Neodol 25-7 (at 120° F.) | 19.7% |
| Minors (Color, Perfume, Brightener) | 2.3% |
| | 100.0% |

The Neodol is sprayed first, followed by the minors. During overspraying the beads with nonionic surfactant and minors, 3 percent by weight of corn starch is added to the V-blender and thoroughly mixed with the beads. The mixture is then supplied to Happer 11 from which they are supplied to the tablet press.

Any suitable batch type blender that has provision for spraying liquids, in the form of fine droplets or as a mist, such as a Patterson Kelly twin shell blender, can be used. The post addition spraying operation can also be performed on a continuous basis using suitable mixing apparatus such as the Patterson-Kelly Zig-Zag blender.

The resulting granular detergent has the following properties:

| FINISHED PRODUCT PROPERTIES | | |
|---|---|---|
| Cup Weight = | 160 | g. (Sp G. = 0.68) |
| Flow = | 79 | |
| Tack = | 0 | |
| Size Analysis | | |
| On U.S. 20 Mesh = | 1% | |
| On U.S. 40 Mesh = | 20% | |
| On U.S. 60 Mesh = | 52% | |
| On U.S. 80 Mesh = | 20% | |
| On U.S. 100 Mesh = | 5% | |
| On U.S. 200 Mesh = | 2% | |
| Through U.S. 200 Mesh = | 0% | |
| | 100% | |

EXAMPLE 2

An aqueous slurry of the following ingredients is prepared.

| Ingredients (In order of addition) | Amount Percent (based on total crutcher mix) |
|---|---|
| Hot Water (140° F.) | 25.0 |
| Sodium Silicate Solids ($SiO_2/Na_2O$ = 2.4) | 3.5 |
| Sodium tripolyposphate powder (anhydrous) | 13.0 |

The aqueous slurry is mixed well in a steam jacketed vessel to hydrate the phosphate ingredient and then heated to 200° F. with steam.

The following ingredients are then added to the aqueous slurry to form a crutcher mix. The temperature is maintained higher than about 180° F. to prevent hydration of subsequently added anhydrous phosphate builder salt.

| Ingredients (In order of addition) | Amount Percent (based on total crutcher mix) |
|---|---|
| Sodium tripolyphosphate (anhydrous) | 13.0 |
| Water | 25.0 |
| Sodium tripolyphosphate (anhydrous) | 13.0 |
| Sodium carbonate | 7.5 |

The crutcher mix is supplied to a countercurrent spray drying tower at a temperature of about 170° F. and sprayed at a pressure of 800 psig. The tower conditions include a $T_1$ (inlet) air temperature of 650° F. and a $T_2$ (outlet) air temperature of about 235° F.

The spray dried builder beads have a particle size distribution such that 90 percent by weight pass through a 20 mesh screen (U.S. series) and 90 percent by weight are retained on a 200 mesh screen (U.S. series).

The spray dried beads are oversprayed according to the technique used in Example 1 as follows:

| Overspray Formula | Amount Percent |
|---|---|
| Spray dried beads | 78.0 |
| Neodol 25-7 | 19.5 |
| Minor ingredients (optical brighteners, perfume etc.) | 2.5 |
| | 100.0 |

The final product has a cup weight of 180 grams; a flow of 75 percent and a water content of 5 percent by weight. No disintegrating aide is utilized in this example.

EXAMPLE 3

The procedures of Example 2 are followed with a crutcher mix (about 50 percent solids) of the following composition:

| Ingedient | Amount Percent |
|---|---|
| Sodium tripolyphosphate (hexahydrate) | 13.0 |
| Sodium tripolyphosphate (anhydrous) | 26.0 |
| Water | 47.0 |
| Organic Builder "M" (Monsanto Chemical Co.) | 7.5 |
| Sodium silicate (solids) | 6.5 |
| | 100.0 |

The spray dried builder beads are oversprayed as follows using the technique of Example 1.

| Ingredient | Amount Percent |
|---|---|
| Spray dried builder beads | 85.0 |
| Nonionic (Neodol 45-11) | 12.0 |
| Minor Ingredients | 3.0 |
| | 100.0 |

The resulting granular detergent is free flowing, nontacky and suitable for compression into detergent tablets according to the invention.

EXAMPLE 4

Example 1 is repeated using Alfonic 1618-65 nonionic detergent in an amount to provide a final granular detergent having a 30 percent by weight nonionic content.

EXAMPLE 5

Crutcher mixes having the following compositions are prepared according to the procedures of Example 1.

| | Amount Percent | | | |
|---|---|---|---|---|
| Ingredient | I | II | III | IV |
| Sodium tripolyphosphate (hexahydrate) | 10 | 12 | 18 | 20 |
| Sodium silicate solids ($SiO_2/Na_2O$ = 2.4) | 3 | 8 | 6 | 4 |
| Sodium tripolyhosphate (Anhydrous) | 30 | 30 | 26 | 28 |
| Water | 57 | 50 | 50 | 48 |

Crutcher mixes I, II, III, and IV are spray dried according to the procedures outlined in Example I. The spray dried beads are oversprayed as follows:

| | Amount Percent | | | |
|---|---|---|---|---|
| Ingredient | I | II | III | IV |
| Spray dried beads | 74.5 | 80.5 | 59 | 83 |
| Minor ingredients | 0.5 | 1.5 | 1 | 2 |
| Neodol 45-11 | — | 18.0 | — | — |
| Neodol 25-7 | 25.0 | — | 40 | — |
| Alfonic 1618-65 | — | — | — | 15 |

The resulting granular detergents from runs I, II, III, and IV are free flowing and are suitable for compression into detergent tablets.

EXAMPLE 6

Spray dried base builder beads produced from crutcher mixers I–IV of Example 5 are oversprayed as follows:

| Ingredient | I | II | III | IV |
|---|---|---|---|---|
| Spray dried base builder beads | 94 | 79.9 | 73.5 | 79.4 |
| Neodol 25-7 | — | 15 | 20 | 12 |
| Linear tridecyl benzene sulfonate | — | 3 | — | 5 |
| AROSURF TA1OO (sprayed at 180–210° F.) | 6 | | | |
| Bluing agent | — | 0.1 | — | 0.1 |
| Optical brightener | — | 2 | 1.5 | 1 |
| Enzyme compound (dispersed in a vehicle) | — | — | 1 | 0.5 |

EXAMPLE 7

The finished base beads of any of Examples 1–6 are supplied to the vessel 11. The base beads are then supplied to the tablet cavity 14 of tablet press 12 and compressed at a pressure of about 1 ton per square inch to produce tablets 15. The tablets 15 have greater physical integrity during production, distribution and consumer use than conventional and prior art tablets.

The formulations II, III and IV of Example are suitable for use as laundry detergents in Tablet form. The formulation I of Example 6 is a fabric softener that can be used in a washing machine in tablet form.

The various post spray drying ingredients of example 6 and those of the other examples can be applied to the base beads either separately or in any suitable combination.

The present process allows the production of laundry tablets from free-flowing detergent beads that are produced by a method which does not produce pollution (fuming or pluming) and which is economically feasible, with high throughputs, utilizing conventional plant equipment. In addition to making free-flowing beads, the base beads are also non-tacky and have improved water solubility relative to prior art detergent powders particularly when in the form of a tablet according to the invention. Lengthy aging periods are not necessary for the spray dried detergent intermediate beads before they can be treated with the aforementioned overspray ingredients and such aging periods are not needed before filling may be effected. With various other methods for making detergent particles containing nonionics, such aging or curing periods are required, thereby slowing production and causing tying up of storage facilities.

The invention has been described with reference to various specific and preferred embodiments and techniques. However, it should be understood that many variations and modification may be made within a scope of the invention, which is defined by the following claims:

I claim:

1. A cleaning tablet comprising a detergent composition produced by:

(a) hydrating a first quantity of anhydrous phosphate builder salt to the maximum in the presence of an alkali metal silicate using sufficient water to form a hydrated slurry;

(b) adding a second quantity of anhydrous phosphate builder salt to said hydrated slurry to form a crutcher mix;

(c) spray drying said crutcher mix to form a particulate material, the weight ratio of said first quantity of builder salt to said alkali metal silicate being from about 1.5 to about 5 and the weight ratio of said first quantity of builder salt to said second quantity of builder salt being from about 0.3 to about 0.7;

(d) combining said particulate material with from about 2 to about 40 percent by weight of an organic material chosen from the group consisting of, nonionic surface active agents and mixtures thereof;

(e) compressing said particulate material to form coherent tablets said particulate material prior to tableting having a flowability of at least about 70% that of clean dry sand, said particulate material comprising:

from about 60 to 88 percent by weight of spray dried base beads having detergent building properties, comprising from about 45 to about 85% bt weight of an alkali metal phosphate wherein from about 30 to about 60 percent of the phosphate is hydrated and the remainder is anhydrous, from about 5 to about 15 percent by weight of a sodium silicate having an $Na_2O:SiO_2$ ratio of from about 1:1.6 to about 1:3.4 and from about 5 to about 15% water, wherein a portion of the water is present as water of hydration in the hydrated phosphate, the beads being essentially free of organic surfactant, organic detergent or soap, when spray dried;

from about 12 to about 40 percent by weight of a nonionic polyethoxylated synthetic organic detergent;

said beads having a structure of microcrystals and amorphous solid interconnected as an irregular network within the beads, the network defining interconnected irregularly shaped passageways, said passageways comprising a reticular void space within the beads and interconnecting to discrete openings on the external surface of the beads;

the nonionic detergent being applied to the external surfaces of the spray dried beads and being substantially absorbed into the internal passageways of the beads to produce the granular detergent;

the beads, before tableting, having a specific gravity of from about 0.5 to about 0.8;

at least 90% of the beads and the granular detergent having a particle size distributed between 20 mesh and 200 mesh U.S. sieve series, and the beads, during tableting, being subjected to compression forces of between about ¾ ton to about 3 tons per square inch.

2. A cleaning tablet according to claim 1 wherein said hydrated slurry is heated to a temperature from about 170° F. to about 200° F. after maximum hydration of the first quantity of builder salt.

3. A cleaning tablet according to claim 1 wherein additional water is added to said aqueous slurry with the addition of said second quantity of anhydrous phosphate.

4. A cleaning tablet according to claim 1 wherein said hydrating step is performed at a temperature suitable for hydrating said first quantity of phosphate builder salt to a maximum and said slurry is then raised to a temperature that would prevent any significant hydration of said second quantity of phosphate builder salt.

5. A cleaning tablet according to claim 1 wherein the weight ratio of said first quantity to said second quantity is about 0.5.

6. A cleaning tablet according to claim 1 wherein said crutcher mix contains from about 40 to about 55 percent solids.

7. A cleaning tablet according to claim 1 wherein said spray drying takes place in a countercurrent spray tower at a spray pressure from about 200 psig to about 1000 psig and an inlet air temperature from about 500° F. to about 700° F.

8. A cleaning tablet according to claim 1 wherein up to 10 percent by weight based on the crutcher solids, of builder salts is added to said crutcher mix, said builder salts being chosen from the group consisting of carbonates, citrates, silicates or combinations thereof having detergent building properties.

9. A cleaning tablet according to claim 1 wherein a quantity of a liquid or semi-solid nonionic detergent material is sprayed onto said bead such that said nonionic detergent impregnates said bead, said quantity of nonionic being about 10 to about 40 percent by weight of said based bead.

10. A cleaning tablet according to claim 1 further includes mixing with the particulate material and organic material about 1 to about 5 percent of a disintegrating aide.

11. A cleaning tablet according to claim 1 wherein said compressing step is performed in a tableting press with the application of from about ¾ to about 1 ton per square inch of pressure.

12. A cleaning tablet according to claim 1 wherein said hydrating step (a) is performed in an aqueous medium and at a temperature of at least about 140° F. and not greater than about 170° F.;

the temperature of said hydrated slurry is raised to more than about 170° F. and less than about 200° F.; and said hydrated slurry and said crutcher mix are maintained at temperatures of at least about 170° F. through the steps of adding the second quantity of anhydrous sodium tripolyphosphate and supplying said crutcher mix to a spray drying tower.

13. A method for producing cleaning tablets comprising hydrating a first quantity of anhydrous phosphate builder salt in the presence of a second quantity of alkali metal silicate to form a hydrated aqueous slurry; adding a third quantity of anhydrous phosphate builder salt to said hydrated slurry to form a crutcher mix; spray drying said crutcher mix to form a particulate material, the weight ratio of said first quantity to said second quantity being from about 1.5 to about 5, the weight ratio of said first quantity to said third quantity being from about 0.3 to about 0.7, combining said particulate with from about 2 to about 40 percent by weight of a liquid or liquifiable organic surface active agent to form detergent beads, compressing said material to form coherent tablets and wherein said hydrating step is performed at a temperature suitable for hydrating said first quantity of phosphate builder salt and said slurry is raised to a temperature that would inhibit hydration of said third quantity of phosphate builder salt.

14. The method of claim 13 further including the steps of heating said hydrated slurry to a temperature from about 170° to about 200° F.

15. The method of claim 13 further including the addition of water to said hydrated slurry.

16. The method of claim 13 wherein the weight ratio of said first quantity to said third quantity is about 0.5.

17. The method of claim 13 wherein said crutcher mix contains from about 40 to about 55 percent solids.

18. The method of claim 13 wherein said spray drying takes place in a countercurrent spray tower at a spray pressure from about 200 psig to about 1000 psig and an inlet air temperature from about 500° F. to about 700° F.

19. The method of claim 13 including the addition of up to 10 percent by weight based on the crutcher solids, of builder salts chosen from the group consisting of carbonates, citrates and silicates having detergent building properties or combinations thereof.

20. The method of claim 13 further including the step of mixing said particulate material and organic material with a disintegrating aide.

21. The method of claim 13 wherein said compressing step is performed in a tableting press with the application of from about ¾ to about 1 ton per square inch of pressure.

* * * * *